US006668778B1

(12) United States Patent
Smith

(10) Patent No.: US 6,668,778 B1
(45) Date of Patent: Dec. 30, 2003

(54) USING DIFFERENTIAL PRESSURE CONTROL SYSTEM FOR VCT LOCK

(75) Inventor: Franklin R. Smith, Cortland, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/392,411

(22) Filed: Mar. 19, 2003

Related U.S. Application Data

(60) Provisional application No. 60/410,370, filed on Sep. 13, 2002.

(51) Int. Cl.[7] ..... F01L 1/34

(52) U.S. Cl. ..... 123/90.17; 123/90.15; 92/5 L

(58) Field of Search ..... 123/90.17, 90.15–90.16, 123/90.31; 92/120–125, 5 L; 464/2

(56) References Cited

U.S. PATENT DOCUMENTS 5,046,460 A * 9/1991 Butterfield et al. ..... 123/90.15
5,172,659 A 12/1992 Butterfield et al. ..... 123/90.17
6,481,402 B1 * 11/2002 Simpson et al. ..... 123/90.17
6,550,436 B2 * 4/2003 Nohara et al. ..... 123/90.16

OTHER PUBLICATIONS

Gardner et al., US Patent Application Publication 2003/0033998, Variable Camshaft Timing, Feb. 20, 2003.*

* cited by examiner

*Primary Examiner*—Thomas Denion
*Assistant Examiner*—Kyle Riddle
(74) *Attorney, Agent, or Firm*—Brown & Michaels, PC; Greg Dziegielewski

(57) ABSTRACT

A variable cam timing system comprising a VCT locking pin in hydraulic communication with the control circuit of the differential pressure control system (DPCS) is provided. When the control pressure is less than 50% duty cycle the same control signal commands the locking pin to engage and the VCT to move toward the mechanical stop. When the control pressure is greater than 50% duty cycle the locking pin disengages and the VCT moves away from the mechanical stop.

5 Claims, 2 Drawing Sheets

USING DIFFERENTIAL PRESSURE CONTROL SYSTEM FOR VCT LOCK

REFERENCE TO RELATED APPLICATIONS

This application claims an invention which was disclosed in U.S. Provisional Application No. 60/410,370, filed Sep. 13, 2002, entitled "Using Differential Pressure Control System for VCT Lock". The benefit under 35 USC §119(e) of the United States provisional application is hereby claimed, and the aforementioned application is hereby incorporated herein by reference.

BACKGROUND OF THE INVENTION

1. Field of the Invention

The invention is related to a hydraulic control system for controlling the operation of a variable camshaft timing (VCT) system. More specifically, the present invention relates to a control system utilized to lock and unlock a lock pin in a VCT phaser.

2. Description of Related Art

Internal combustion engines have employed various mechanisms to vary the angle between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). In most cases, the phasers have a rotor with one or more vanes, mounted to the end of the camshaft, surrounded by a housing with the vane chambers into which the vanes fit. It is possible to have the vanes mounted to the rotor, and the chambers in the housing, as well. The housing's outer circumference forms the sprocket, pulley or gear accepting drive force through a chain, belt or gears, usually from the camshaft, or possibly from another camshaft in a multiple-cam engine. The flow of control fluid (usually engine oil) to and from the vane chambers is controlled by a spool valve.

The VCT system also includes a differential pressure control system (DPCS) for controlling the position of the spool valve. The DPCS utilizes hydraulic force on both ends of the spool. Hydraulic force present on the first end is directly applied hydraulic fluid from the engine oil gallery at full hydraulic pressure. The hydraulic force present on the second end of the spool, which is larger than the first end, is system hydraulic fluid at a reduced pressure from a pulse width modulated (PWM) solenoid or valve.

The second end of the spool is a hydraulic force multiplier—a piston whose cross-sectional area is exactly double the cross-sectional area of the first end of the spool, which is acted on directly by system hydraulic pressure. In this way, the hydraulic forces acting on the spool will be exactly in balance when the hydraulic pressure within the force multiplier is exactly equal to one-half that of system hydraulic pressure. This condition is achievable with a pulse width modulated (PWM) solenoid or valve duty cycle of 50%. The duty cycle of 50% is desirable because it permits equal increases and decreases in force at the force multiplier end of the spool to move the spool in one direction or the other by the same amount. Because the force at each of the opposed ends of the spool is hydraulic in origin, and is based on the same hydraulic fluid, changes in pressure or viscosity of the hydraulic fluid will be self-negating and will not affect the centered or null position of the spool.

The rate in which the spool is moved may be varied by increasing or decreasing the duty cycle of the PWM solenoid or valve. U.S. Pat. No. 5,172,659 is hereby incorporated by reference. Furthermore, it is desirable to fix the angular relationship of the phaser when insufficient fluid pressure is present. By way of example, if insufficient fluid pressure is present, the hydraulic fluid flow for sustaining the vane positions is not capable of maintaining the positions, thereby undesirable vibrations may occur. In order to reduce or eliminate the undesirable vibrations, the angular position of the phaser needs to be maintained using means other than the low fluid pressure. Therefore, it is desirable to have a device and method for using a single source such as the PWM solenoid or valve to achieve both the control of the vane position, and when the vane position cannot be maintained, lock the phaser and hence the vane in a suitably fixed position.

SUMMARY OF THE INVENTION

A VCT phaser control system having a locking pin controlled by DPCS control pressure is provided.

A variable cam timing system is provided which comprises a VCT locking pin in hydraulic communication with the control circuit of the differential pressure control system (DPCS).

A variable cam timing system is provided which comprises a VCT locking pin in hydraulic communication with the control circuit of the differential pressure control system (DPCS). Whereby the hydraulic fluid used for controlling the DPCS is also used for operating the VCT locking pin.

A variable cam timing system comprising a VCT locking pin in hydraulic communication with the control circuit of the differential pressure control system (DPCS) is provided. When the control pressure is less than 50% duty cycle the same control signal commands the locking pin to engage and the VCT to move toward the mechanical stop. When the control pressure is greater than 50% duty cycle the locking pin disengages and the VCT moves away from the mechanical stop.

Accordingly, a variable cam timing (VCT) phaser control system for a phaser is provided, which includes: a spool valve disposed to be spring loaded to a null position from fluid pressures at a first end and a second end, the first end being subject to a control fluid and the second end having an area being subject to source fluid; a piston engaging a first end of the spool valve, the piston having an opposite side having a area substantially greater than the area of the second end being subject to source fluid; a locking pin locking the phaser at a fixed angular position, thereby controlling the locking pin free of addition control means; and a controller in fluid communication with both the piston and the locking pin for controlling the control fluid characteristics.

DETAILED DESCRIPTION OF THE INVENTION

Figure 1:
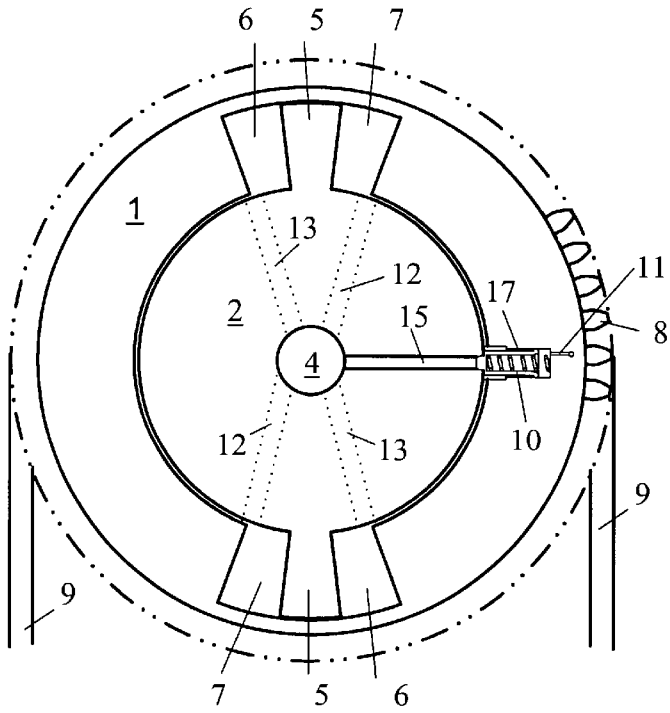
FIG. 1 shows a phaser with a locking pin of the present invention.

Referring to FIG. 1, a vane-type VCT phaser comprises a housing (1), the outside of which has sprocket teeth (8) which mesh with and are driven by timing chain (9). Inside the housing (1) are fluid chambers (6) and (7). Coaxially within the housing (1), free to rotate relative to the housing, is a rotor (2) with vanes (5) which fit between the chambers (6) and (7), and a central control valve (4) which routes pressurized oil via passages (12) and (13) to chambers (6) and (7), respectively. Pressurized oil introduced by valve (4) into passages (12) will push vanes (5) counterclockwise relative to the housing (1), forcing oil out of chambers (6) into passages (13) and into valve (4). It will be recognized by one skilled in the art that this description is common to vane phasers in general, and the specific arrangement of vanes, chambers, passages and valves shown in FIG. 1 may be varied within the teachings of the invention. For example, the number of vanes and their location can be changed, some phasers have only a single vane, others as many as a dozen, and the vanes might be located on the housing and reciprocate within chambers on the rotor. The housing might be driven by a chain or belt or gears, and the sprocket teeth might be gear teeth or a toothed pulley for a belt.

Referring again to FIG. 1, in the phaser of the invention, a locking pin (10) slides in a bore (17) in the housing (1), and is pressed by a spring (21) into a recess (not shown) in the rotor (2) to lock the rotor (2) and housing (1) into a fixed rotational position. A fluid passage (15) feeds controlled fluid such as pressurized oil from the engine oil supply (not shown) and processed by a controller (see infra) into the recess. The piston (40) is sized so as to fit in and fully block passage (15) when the locking pin (10) is engaged.

Figure 2:
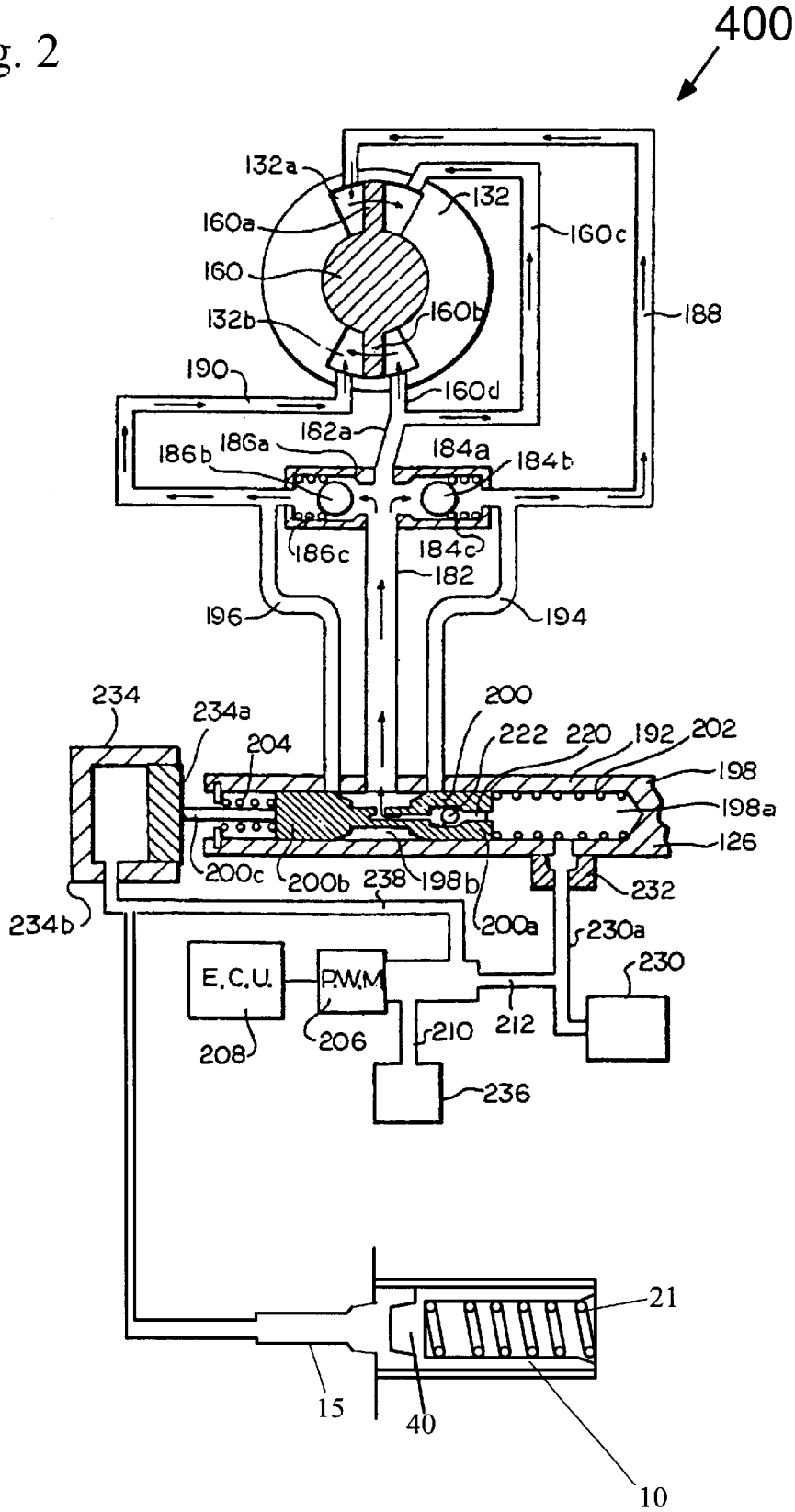
FIG. 2 shows an embodiment of the present invention.

Referring to FIG. 2, a VCT mechanism (400), hydraulic fluid, illustratively in the form of engine lubricating oil, flows into the recesses (132*a*, 132*b*) by way of a common inlet line (182). The inlet line (182) terminates at a juncture between opposed check valves (184 and 186) which are connected to the recesses (132*a*, 132*b*), respectively, by branch lines (188, 190), respectively. The check valves (184, 186) have annular seats (184*a*, 186*a*), respectively, to permit the flow of hydraulic fluid through the check valves (184, 186) into the recesses (132*a*, 132*b*), respectively. The flow of hydraulic fluid through the check valves and (184, 186) is blocked by floating balls (184*b*, 186*b*), respectively, which are resiliently urged against the seats (184*a*, 186*a*), respectively, by springs (184*c*, 186*c*), respectively. The check valves (184, 186), thus, permit the initial filling of the recesses (132*a*, 132*b*) and provide for a continuous supply of make-up hydraulic fluid to compensate for leakage therefrom. Hydraulic fluid enters the line (182) by way of a spool valve (192), which is incorporated within the camshaft (126) or an extension thereof, and hydraulic fluid is returned to the spool valve (192) from the recesses (132*a*, 132*b*) by return lines (194, 196), respectively.

The spool valve (192) is made up of a cylindrical member (198) and a spool (200) which is slidable to and fro within the member (198). The spool (200) has cylindrical lands or first and second ends (200*a* and 200*b*) on opposed ends thereof, and the lands (200*a* and 200*b*), which fit snugly within the member (198), are positioned so that the land (200*b*) will block the exit of hydraulic fluid from the return line (196), or the land (200*a*) will block the exit of hydraulic fluid from the return line (194), or the lands (200*a* and 200*b*) will block the exit of hydraulic fluid from both the return lines (194 and 196), as is shown in FIG. 2, where the camshaft (126) is being maintained in a selected intermediate position relative to the crankshaft of the associated engine.

The position of the spool (200) within the member (198) is influenced by an opposed pair of springs (202, 204) which act on the ends of the lands (200*a*, 200*b*), respectively. Thus, the spring (202) resiliently urges the spool (200) to the left, in the orientation illustrated in FIG. 2, and the spring (204) resiliently urges the spool (200) to the right in such orientation. The position of the spool (200) within the member (198) is further influenced by a supply of pressurized hydraulic fluid within a portion (198*a*) of the member (198), on the outside of the land (200*a*), which urges the spool (200) to the left. The portion (198*a*) of the member (198) receives its pressurized fluid (engine oil) directly from the main oil gallery ("MOG") (230) of the engine by way of a conduit (230*a*), and this oil is also used to lubricate a bearing (232) in which the camshaft (126) of the engine rotates.

The control of the position of the spool (200) within the member (198) is in response to hydraulic pressure within a control pressure cylinder (234) whose piston (234*a*) bears against an extension (200*c*) of the spool (200). The surface area of the piston (234*a*) is greater than the surface area of the end of the spool (200) which is exposed to hydraulic pressure within the portion (198), and is preferably twice as great. Thus, the hydraulic pressures which act in opposite directions on the spool (200) will be in balance when the pressure within the cylinder (234) is one-half that of the pressure within the portion (198*a*), assuming that the surface area of the piston (234*a*) is twice that of the end of the land (200*a*) of the spool. This facilitates the control of the position of the spool (200) in that, if the springs (202 and 204) are balanced, the spool (200) will remain in its null or centered position, as illustrated in FIG. 2, with less than full engine oil pressure in the cylinder (234), thus allowing the spool (200) to be moved in either direction by increasing or decreasing the pressure in the cylinder (234), as the case may be. Further, the operation of the springs (202, 204) will ensure the return of the spool (200) to its null or centered position when the hydraulic loads on the ends of the lands (200*a*, 200*b*) come into balance. While the use of springs such as the springs (202, 204) is preferred in the centering of the spool (200) within the member (198), it is also contemplated that electromagnetic or electro-optical centering means can be employed, if desired.

The pressure within the cylinder (234) is controlled by a solenoid (206), preferably of the pulse width modulated type (PWM), in response to a control signal from an electronic engine control unit (ECU) (208), shown schematically, which may be of conventional construction. With the spool (200) in its null position when the pressure in the cylinder (234) is equal to one-half the pressure in the portion (198*a*), as heretofore described, the on-off pulses of the solenoid (206) will be of equal duration; by increasing or decreasing the on duration relative to the off duration, the pressure in the cylinder (234) will be increased or decreased relative to such one-half level, thereby moving the spool (200) to the right or to the left, respectively. The solenoid (206) receives engine oil from the engine oil gallery (230) through an inlet line (212) and selectively delivers engine oil from such source to the cylinder (234) through a supply line (238). Excess oil from the solenoid (206) is drained to a sump (236) by way of a line (210). It is noted that the cylinder (234) may be mounted at an exposed end of the camshaft (126) so that the piston (234*a*l bears against an exposed free end (200*c*) of the spool (200). In this case, the solenoid (206) is preferably mounted in a housing (234*b*) which also houses the cylinder (234*a*).

By using imbalances between oppositely acting hydraulic loads from a common hydraulic source on the opposed ends of the spool (200) to move it in one direction or another, as opposed to using imbalances between an hydraulic load on one end and a mechanical load on an opposed end, the control system of FIG. 2 is capable of operating independently of variations in the viscosity or pressure of the hydraulic system. Thus, it is not necessary to vary the duty cycle of the solenoid (208) to maintain the spool (200) in any given position, for example, in its centered or null position, as the viscosity or pressure of the hydraulic fluid changes during the operation of the system. In that regard, it is to be understood that the centered or null position of the spool (200) is the position where no change in camshaft to crankshaft phase angle is occurring, and it is important to be able to rapidly and reliably position the spool (200) in its null position for proper operation of a VCT system.

Make-up oil for the recesses (132*a*, 132*b*) of the sprocket (132) to compensate for leakage therefrom is provided by way of a small, internal passage (220 within the spool (200), from the passage (198*a*) to an annular space (198*b*) of the cylindrical member (198), from which it can flow into the inlet line (182). A check valve (222) is positioned within the passage (220) to block the flow of oil from the annular space (198*b*) to the portion (198*a*) of the cylindrical member (198).

The vane (160) is alternatively urged in clockwise and counterclockwise directions by the torque pulsations in the camshaft (126) and these torque pulsations tend to oscillate the vane (160), and, thus, the camshaft (126), relative to the sprocket (132). However, in the FIG. 2 position of the spool (200) within the cylindrical member (198, such oscillation is prevented by the hydraulic fluid within the recesses (132*a*, 132*b*) of the sprocket (132) on opposite sides of the lobes (160*a*, 160*b*), respectively, of the vane (160), because no hydraulic fluid can leave either of the recesses (132*a*, 132*b*), since both return lines (194, 196) are blocked by the position of the spool (200), in the FIG. 2 condition of the system. If, for example, it is desired to permit the camshaft (126) and vane (160) to move in a counterclockwise direction with respect to the sprocket (132, it is only necessary to increase the pressure within the cylinder (234) to a level greater than one-half that in the portion (198*a*) of the cylindrical member. This will urge the spool (200) to the right and thereby unblock the return line (194). In this condition of the apparatus, counterclockwise torque pulsations in the camshaft (126) will pump fluid out of the portion of the recess (132*a*) and allow the lobe (160*a*) of vane (160) to move into the portion of the recess which has been emptied of hydraulic fluid. However, reverse movement of the vane will not occur as the torque pulsations in the camshaft become oppositely directed unless and until the spool (200) moves to the left, because of the blockage of fluid flow through the return line (196) by the land (200*b*) of the spool (200). While illustrated as a separate closed passage in FIG. 2, the periphery of the vane (160) has an open oil passage slot (not shown), which permits the transfer of oil between the portion of the recess (132*a*) on the right side of the lobe (160*a*) and the portion of the recess (132*b*) on the right side of the lobe (160*b*), which are the non-active sides of the lobes (160*a*, 160*b*); thus, counterclockwise movement of the vane (160) relative to the sprocket (132) will occur when flow is permitted through return line (194) and clockwise movement will occur when flow is permitted through return line (196).

Further, the passage (182) is provided with an extension (182*a*) to the non-active side of one of the lobes (160*a*, 160*b*), shown as the lobe (160*b*), to permit a work continuous supply of make-up oil to the non-active sides of the lobes (160*a*, 160*b*) for better rotational balance, improved damping of vane motion, and improved lubrication of the bearing surfaces of the vane (160). It is to be noted that the supply of make-up oil in this manner avoids the need to route the make-up oil through the solenoid (206). Thus, the flow of make-up oil does not affect, and is not affected by, the operation of the solenoid (206). Specifically make-up oil will continue to be provided to the lobes (160*a*, 160*b*) in the event of a failure of the solenoid (206), and it reduces the oil flow rates that need to be handled by the solenoid (206).

It is noted that the check valves (184 and 186) may be disc-type check valves as opposed to the ball type check valves of FIG. 2. While disc-type check valves may be preferred for some embodiments, it is to be understood that other types of check valves can also be used.

Referring again to FIG. 2, a differential pressure control system (DPCS) (234) is used to move the spool valve (192) that controls the actuation rate and direction of a VCT mechanism (400). The DPCS (234) consists of a spool valve (192) that is spring loaded. In other words, spool valve (192) possesses a first side (200*b*) and a second side (200*a*), in which each side has an area that is respectively connected to springs (202, 204). One end of the spool valve (192) i.e. the area on the first side (200*b*) is contacted by (or comprises) a piston (234*a*) of approximately double the area of the second side (200*a*) of the spool valve (192). "Control fluid" that is modulated via a pulse width modulated (PWM) solenoid (206) is applied to the piston (234*a*) end of the spool valve (192) via passage (238). Source fluid such as oil is supplied to the other end of the spool valve (192). Since the area of the piston (234*a*) is approximately twice that of the other end of the spool valve (192) then the spool valve (192) is balanced in the null position when the control oil pressure is approximately 50% that of source pressure. To move the spool valve (192) off of the null position and actuate the VCT the control pressure needs to be modulated above or below a 50% valve such as the spool valve (192).

A second feature of the VCT is to lock the VCT at either extreme position of travel. When the DPCS (234) pressure drops near 0 PSI, or anything less then 50% duty cycle, the spool valve (192) moves out and commands the VCT toward the extreme position, i.e., the mechanical stop.

FIG. 2 also shows the VCT lock pin (10) incorporated into the same control circuit as the DPCS piston (234*a*). The VCT locking pin (10) is connected the DPCS (234) via a channel (15). The VCT locking pin (10) is now commanded to engage with the same control signal that commands the VCT spool valve (192) to the outward position. At any control pressure with less then 50% duty cycle, the spring (21) urges the locking pin (10) to engage while the VCT moves toward the mechanical stop that is the locked position. By incorporating the VCT locking pin (10) into the same control circuit as the DPCS piston (234*a*) the need for an additional solenoid is eliminated.

It will be understood that the locking pin could be biased, or the pressure applied, such that the pin could be engaged at the other end of PWM modulation at greater than or equal to 50% duty cycle. The above is contemplated within the teachings of the present invention.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing (VCT) phaser control system for a phaser, comprising:

a spool valve disposed to be spring loaded to a null position from fluid pressures at a first end and a second end, the first end being subject to a control fluid and the second end having an area being subject to source fluid;

a piston engaging a first end of the spool valve, the piston having an opposite side having an area substantially greater than the area of the second end being subject to source fluid;

a locking pin locking the phaser at a fixed angular position, thereby controlling the locking pin free of additional control means; and a controller in fluid communication with both the piston and the locking pin for controlling the control fluid characteristics.

2. The system of claim 1, wherein the controller is a differential pressure control system for moving a spool valve that controls actuation rate and direction of a VCT phaser.

3. The system of claim 1, wherein fluid characteristics include control fluid pressure as a function of time.

4. The system of claim 1, wherein the locking pin is spring loaded.

5. The system of claim 1, wherein the opposite side of the piston has an area about twice the area of the second end being subject to source fluid.

* * * * *